United States Patent [19]

Birdsall

[11] 3,980,113

[45] Sept. 14, 1976

[54] PENCIL SHARPENER

[75] Inventor: John D. Birdsall, Los Angeles, Calif.

[73] Assignee: Hasbro Development Corporation, Pawtucket, R.I.

[22] Filed: Oct. 28, 1975

[21] Appl. No.: 626,578

[52] U.S. Cl. ..... 144/28.6; 144/28.71; 145/3.1; 145/3.31; 145/3.61

[51] Int. Cl.[2] ..... B43L 23/02

[58] Field of Search ..... 145/3.1, 3.31, 3.61; 144/28.11, 28.2, 28.6, 28.7, 28.71

[56] References Cited

UNITED STATES PATENTS

| | | | |
|---|---|---|---|
| 1,197,157 | 9/1916 | Spengler | 144/28.71 |
| 1,275,982 | 8/1918 | Ormiston | 145/3.61 |
| 1,283,584 | 11/1918 | Spengler | 144/28.71 |
| 1,636,552 | 7/1927 | Clare | 144/28.71 |
| 2,123,511 | 7/1938 | Lobel et al. | 144/28.71 |

FOREIGN PATENTS OR APPLICATIONS

| | | | |
|---|---|---|---|
| K22,939 | 10/1956 | Germany | 144/28.71 |
| 957,191 | 1/1957 | Germany | 144/28.71 |
| 962,678 | 4/1957 | Germany | 144/28.6 |

*Primary Examiner*—Al Lawrence Smith
*Assistant Examiner*—J. T. Zatarga
*Attorney, Agent, or Firm*—Salter & Michaelson

[57] ABSTRACT

A pencil sharpener having a base on which a sharpening assembly, including sharpening rollers, is mounted, a housing defined by a hollow figure formed of a flexible, deformable material and simulating the head of an animal enveloping the sharpening assembly, and a member being mounted for rotating movement with the sharpening assembly interiorly of the hollow figure and being engageable with the interior surfaces of the hollow figure, so that upon rotation of the sharpening assembly, the member distorts the simulated animal head to produce the effect that the simulated animal head is chewing the pencil during the pencil sharpening operation.

10 Claims, 12 Drawing Figures

PENCIL SHARPENER

BACKGROUND OF THE INVENTION

The present invention relates to a pencil sharpener and has particular application as a play action device for producing an interesting and unusual effect during the pencil sharpening operation.

Prior to the instant invention, the conventional pencil sharpener has included a base to which a mounting bracket was secured, a removable housing being mounted on the bracket and enclosing the sharpener rollers and being constructed for receiving the pencil shavings during the pencil sharpening operation. Although the prior known pencil sharpener performed the operation of sharpening a pencil in an efficient manner, there was never any attempt made in its construction to form a device in a manner that was unusual or interesting in the operation thereof. Some prior known pencil sharpeners have included various color combinations in the components thereof, and in some of the prior known devices, the housing for the pencil shavings has been constructed in a configuration that deviated from the normal shape; but in practically all of the heretofore known pencil sharpeners, the construction thereof followed a well-recognized and accepted pattern.

SUMMARY OF THE INVENTION

The present invention is directed to an unique form of a pencil sharpener that adds play value to the usual procedure of sharpening a pencil and is both unusual and interesting in the appearance and use thereof.

The pencil sharpener of the present invention includes the usual base and bracket that is attached to the base on which the sharpener assembly is mounted for rotation relative thereto. However, the subject invention deviates from the prior known construction by providing a housing in the form of a hollow figure that is formed of a deformable plastic material. The hollow figure is designed to be provocative in the appearance thereof, and may take the form of an animal's head, or any well-known figure that would provide an interesting effect in use of the device. Attached to the sharpener assembly is a cam member that engages the interior surface of the deformable hollow figure, so that upon rotation of the sharpener rollers during the pencil sharpening operation, the figure is distorted in a comical and interesting manner. In order to add to the play value of the device, an opening is formed in the figure in a location that simulates the mouth thereof, the opening being positioned such that the pencil to be sharpened is inserted therein for location between the sharpening rollers of the sharpening assembly. Thus, as the handle of the sharpener is rotated for sharpening a pencil, the cam member mounted on the sharpener assembly distorts the hollow figure and gives the impression that as the pencil is sharpened it is being chewed by the figure.

Accordingly, it is an object of the present invention to provide a pencil sharpener having a housing in the form of a deformable head and that is distorted during the pencil sharpening operation to render the impression that the pencil is being chewed as it is being sharpened.

Other object, features and advantages of the invention will become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
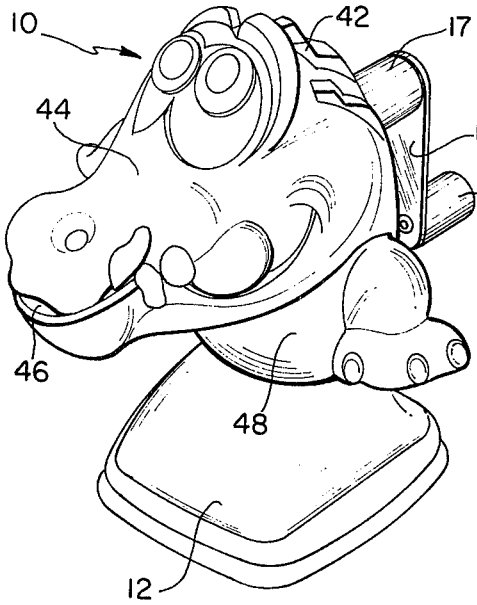
FIG. 1 is a perspective view of the pencil sharpener embodied in the present invention showing one form of an animal figure used in conjunction therewith.
Figure 2:
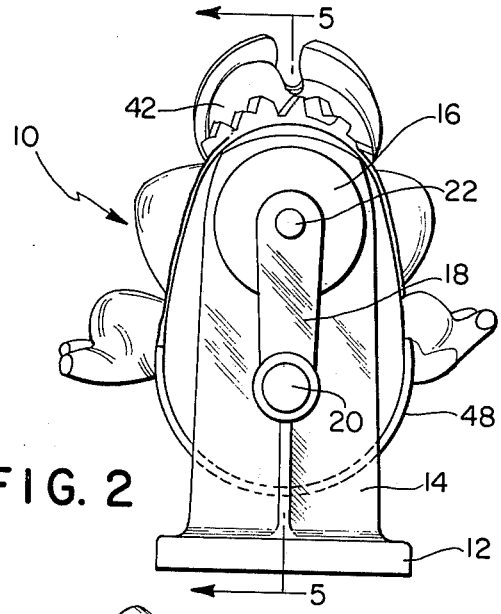
FIG. 2 is a rear elevational view thereof.
Figure 4:
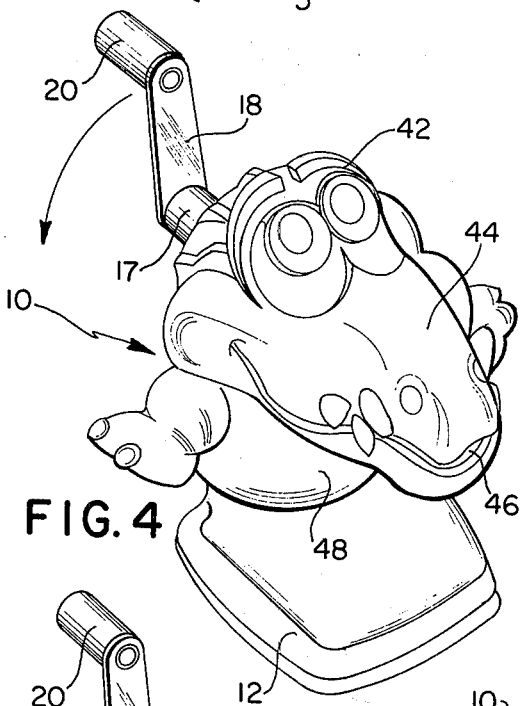
FIG. 4 is a view similar to FIG. 3 showing another position of the handle of the sharpener assembly during the pencil sharpening operation.

Referring now to the drawings, and particularly to FIGS. 1 through 5, the pencil sharpener embodied in the present invention is illustrated and is generally indicated at 10. The pencil sharpener 10 includes a base 12 of conventional construction, the base 12 being mountable on a horizontal or a vertical surface in any convenient manner such as by screw fasteners or the like, or by a vacuum clutch device. Joined to the base 12 and extending upwardly therefrom is a mounting bracket 14 on the uppermost end of which a frustro-conical portion 16 is joined that receives a shaft 17. Joined to the shaft 17 by a screw 22 is a lever 18 that has a handle 20 rotatably mounted on the outermost end thereof. Fixed to the portion of the shaft 17 that extends through the frustro-conical portion 16 is a sharpener assembly generally indicated at 24 that include sharpener rollers 26 that are inclined in the usual manner to define a conical space therebetween for receiving a pencil to be sharpened. Fixed to the sharpener rollers 26 of the sharpener assembly is a frame 28 to which pencil guide 30 is joined, the guide 30 having a bore 32 formed therein for guiding a pencil end between the rollers 26 in the usual manner.

Removably mounted on the bracket 14 is a housing generally indicated at 34 that not only defines a receptacle for receiving the pencil shavings during a pencil sharpening operation, but as will be more specifically set forth, also forms an ornamental, interesting and unusual article that provides a play action effect during the pencil sharpening operation. The housing 34 includes a mounting plate 36 having a threaded opening 38 formed therein and in which notches 40 are also formed. Corresponding lugs and threads are formed on the mounting bracket 14 adjacent to the frustro-conical portion 16 that are received in the threads and notches 40 in the opening 38 in the conventional manner, the mounting plate 36 being rotatable for locking the housing 34 on the bracket 14. Formed as part of the housing 34 and joined to the mounting plate 36 is a hollow toy figure 42 that is shaped and constructed as a replica of the head of an animal or the like, the facial characteristics of the animal being formed in any interesting or unusual manner, as illustrated in FIG. 1 through 4, that will lend a play action effect to the pencil sharpening operation. In the form of the hollow toy FIG. 42 as illustrated herein, an elongated snout 44 is also provided in which an opening 46 is formed in the outermost end thereof, the purpose of which will be described hereinafter. It is understood that the hollow toy FIG. 42 can take various shapes and configurations and can simulate various animals or other original creature forms that will lend the desired effect as described hereinbelow.

Figure 5:
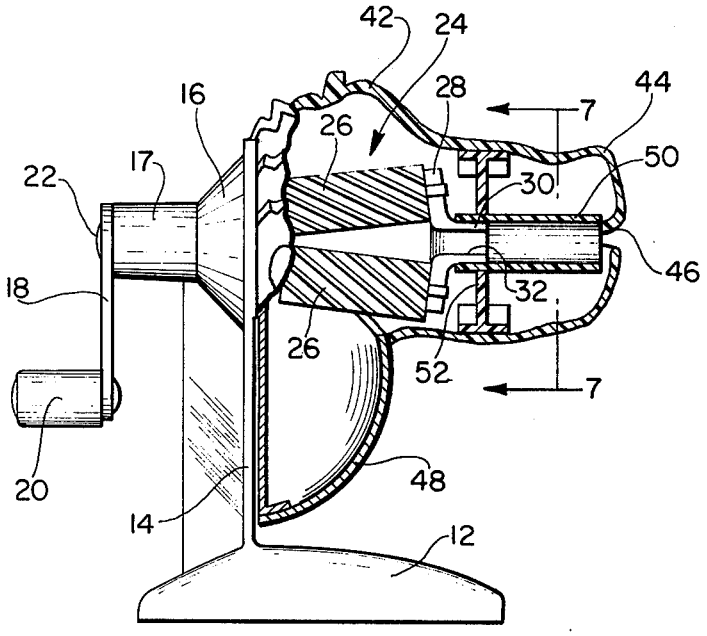
FIG. 5 is a sectional view taken along line 5—5 in FIG. 2.
Figure 6:
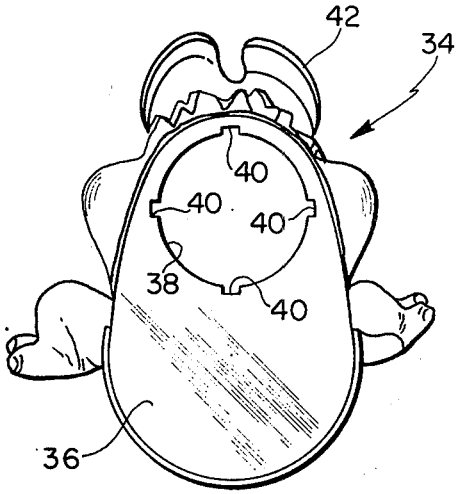
FIG. 6 is a rear elevational view of the hollow figure and rear plate attached thereto.

Also joined to the mounting plate 36 and extending forwardly and upwardly with respect thereto, is a curved wall 48 that is formed as an integral part of the hollow toy FIG. 42. As illustrated in FIG. 5, the space formed between the curved wall 48 and the plate 14 is disposed below the sharpener rollers 26 and thus defines a receptacle for receiving the pencil shavings during a pencil sharpening operation. As will be understood, the wall 48 may also be designed in any configuration desired to complement the appearance of the head 42 of the hollow toy figure.

During a pencil sharpening operation, a pencil to be sharpened is inserted through the opening 46 of the snout 44, but in order for the pencil to be directed into the bore 32 of the pencil guide 30 for insertion between the rollers 26, a tubular extension 50 is provided and is mounted directly on the pencil guide 30. The outermost end of the extension 50 is aligned with and is located adjacent to the opening 46; and as illustrated in FIG. 5, the extension 50 also defines a guide for directing the pencil to be sharpened through the guide 30 for engagement with the sharpening rollers 26. It is understood that in the event that the toy figure as joined to the plate 36 is formed with a snout or other facial contour that does not extend outwardly for that distance as represented by the snout 44, the extension 50 may be shortened or eliminated entirely if necessary.

Figure 10:
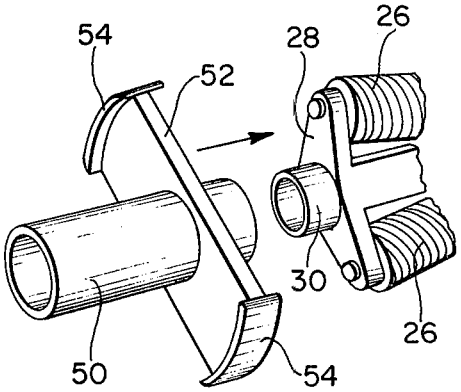
FIG. 10 is an exploded, perspective view of the outer end of the sharpener assembly and the cam member as attached to an extension that is mounted on the sharpener assembly.

During the pencil sharpening operation, the desired effect to be achieved by the invention is that of the toy FIG. 42 chewing the pencil. In order to obtain this effect, a cam member 52 is provided, and in the form of the invention as illustrated herein is formed with a central opening for receiving the extension 50 in frictional engagement therewith. Thus, the cam member 52 rotates with the extension 50, the pencil guide 30, frame 28, and the rollers 26, that form part of the sharpening assembly. As more clearly illustrated in FIG. 10, the cam member 52 includes outer curved flanges 54 that are joined to the outer peripheral edges of the cam member. The flanges 54 are engageable with the interior surfaces of the adjacent walls of the snout 44 of the toy figure, and as will be described will distort the toy figure as the pencil sharpener assembly is rotated.

Figure 3:
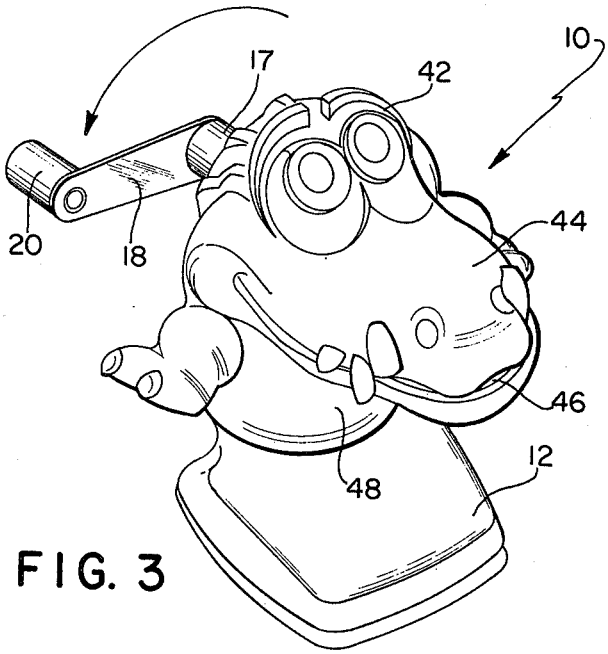
FIG. 3 is a perspective view similar to FIG. 1 illustrating the movement of the sharpening assembly for distorting the figure during the operation thereof.
Figure 3A:
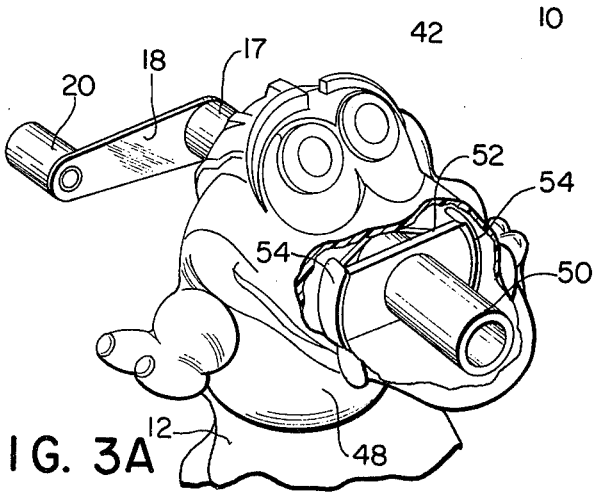
FIG. 3*a* is a view corresponding to FIG. 3, with a portion cut away showing the position of the cam member as attached to the sharpener assembly.
Figure 4A:
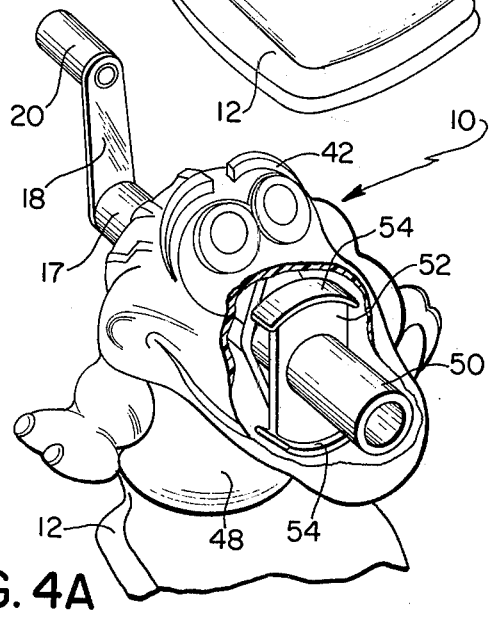
FIG. 4*a* is a view corresponding to FIG. 4 with a portion of the figure cut away for showing the position of the cam member therein.
Figure 7:
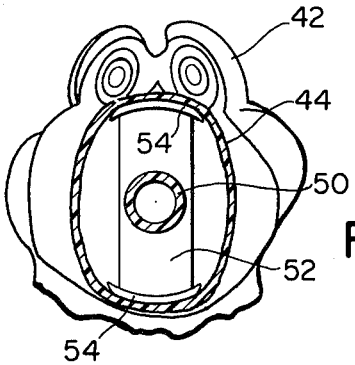
FIG. 7 is a sectional view taken along line 7—7 showing a position of the cam member therein.
Figure 8:
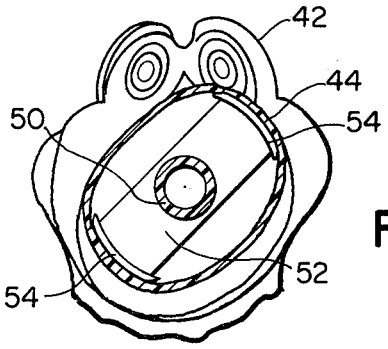
FIG. 8 is a view similar to FIG. 7 showing another position of the cam member.
Figure 9:
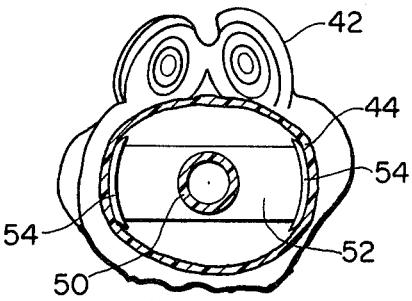
FIG. 9 is a view similar to FIGS. 7 and 8 showing still another position of the cam member.

In order to obtain the desired effect of simulating the chewing of a pencil by the toy FIG. 42 during the pencil sharpening operation, the toy figure is molded of a suitable flexible plastic material. By molding the toy figure of the flexible plastic material, any desired shape and/or design is achieved, and a variety of facial contours can be obtained that when distorted, will provide an interesting effect during the pencil sharpening operation. The longitudinal dimension of the cam member 52 is such that it forces slightly outwardly the walls of the snout 44 of the toy figure with which it engages. Thus, as the sharpening assembly 24 is rotated during a pencil sharpening operation, the engaged walls of the snout 44 will be contorted to produce what appears to be a chewing effect as a pencil is sharpened. As illustrated in FIGS. 3*a* and 9, the longitudinal axis of the cam member is disposed in a generally horizontal position, which position of the cam member 52 forces the snout 44 to follow the contour as illustrated. As the handle 20 of the pencil sharpener is rotated to rotate the sharpener assembly, the cam member 52 is moved therewith as illustrated in FIGS. 4*a* and 7 to a vertical position, thereby distorting the snout 7 in a different direction. Thus, it is seen that as the cam member 52 is rotated to those positions illustrated in FIGS. 7, 8, and 9, the snout 44 and the adjacent walls of the toy figure are distorted to produce what appears to be a chewing effect. It is understood that as the pencil is inserted throught the opening 46, extension 50, guide 30, and between the rollers 26, it will be sharpened as the handle 20 is rotated, the shavings from the pencil dropping into the receptacle formed between the plate 36 and the wall 48. As rotation of the handle 20 continues, and the pencil is sharpened, the walls of the toy figure are continually distorted to produce what appears to be a chewing effect, thereby adding interesting play value to the pencil sharpener during the use thereof.

While there is shown and described herein certain specific structure embodying the invention, it will be manifest to those skilled in the art that various modifications of the parts may be made without departing from the spirit and scope of the underlying inventive concept and that the same is not limited to the particular forms herein shown and described except insofar as indicated by the scope of the appended claim.

What is claimed is:

1. A pencil sharpener, comprising a base to which a mounting bracket is joined, a sharpening assembly mounted for rotation on said mounting bracket and including a handle to which sharpener rollers are operatively interconnected and a pencil guide that is secured to said rollers for guiding a pencil to be sharpened therebetween, a hollow figure formed of a flexible, deformable material and being secured to said sharpening assembly in surrounding relation with respect to said rollers, said figure having an opening formed therein that is aligned with said pencil guide for receiving a pencil to be sharpened therein, and means mounted for rotating movement with said sharpening assembly and interiorly of said hollow figure and being engageable with interior surfaces of said hollow figure, wherein rotation of said sharpening assembly and said means mounted for rotating movement with said sharpening assembly during a pencil sharpening operation causes said means mounted for rotating movement with said sharpening assembly to distort the flexible figure.

2. A pencil sharpener as claimed in claim 1, said hollow figure simulating the head of an animal, said opening in said figure being located such as to simulate the mouth of the animal, wherein insertion of a pencil through said opening for engagement by said rollers during a pencil sharpening operation and the distortion of said hollow figure by said rotating means simulates a chewing motion by said figure.

3. A pencil sharpener as claimed in claim 2, said means mounted for rotating movement with said sharpening assembly being defined by a cam member that includes a cam plate that is operatively mounted on said sharpener assembly for rotation therewith, said cam plate being formed such that the longitudinal extent thereof is of a dimension to cause the extreme ends of said cam member to engage the interior surface of said figure.

4. A pencil sharpener as claimed in claim 3, the extreme ends of said cam member, including curved cam flanges that provide sufficient surface contact with the inner surfaces of said hollow figure to cause a continuing distorting effect of said figure as said sharpener assembly is rotated.

5. A pencil sharpener as claimed in claim 1, a tubular extension joined to said pencil guide and projecting outwardly therefrom within the confines of said hollow figure, the opening in said figure communicating directly with the outermost end of said extension, wherein a pencil inserted into said opening in the figure is directed through said tubular extension and guide between said rollers.

6. A pencil sharpener as claimed in claim 5, said figure simulating the head of an animal, wherein said head includes an elongated snout in which said extension is located.

7. A pencil sharpener as claimed in claim 1, said means mounted for rotating movement with said sharpening assembly being defined by a cam member having a generally rectangular configuration, the extreme outer edges of said cam member defining contact ends that engage the inner surfaces of said hollow figure during the pencil sharpening operation.

8. A pencil sharpener as claimed in claim 1, said hollow figure including a rear plate that is mounted on said mounting bracket, an upwardly curved forward wall joined to the rear plate at the lower end thereof and defining a receptacle therewith that is located beneath said rollers for receiving pencil shavings that are removed from a pencil during the pencil sharpening operation.

9. A pencil sharpener as claimed in claim 8, a tubular extension joined to said pencil guide and projecting outwardly therefrom within the confines of said hollow figure.

10. A pencil sharpener as claimed in claim 9, the opening in said figure communicating directly with the outermost end of said extension, wherein a pencil inserted into said opening in the figure is directed through said tubular extension and guide between said rollers.

* * * * *